US007124611B2

(12) United States Patent
Baulier et al.

(10) Patent No.: US 7,124,611 B2
(45) Date of Patent: Oct. 24, 2006

(54) ROLLER HEMMING MACHINE

(75) Inventors: Dominique Baulier, St. Clair Beach (CA); Gabor Sztvorecz, Windsor (CA)

(73) Assignee: Valiant Corporation, Windsor (CA)

( * ) Notice: Subject to any disclaimer, the term of this patent is extended or adjusted under 35 U.S.C. 154(b) by 0 days.

(21) Appl. No.: 11/247,885

(22) Filed: Oct. 10, 2005

(65) Prior Publication Data

US 2006/0075797 A1 Apr. 13, 2006

Related U.S. Application Data

(60) Provisional application No. 60/617,542, filed on Oct. 8, 2004.

(51) Int. Cl.
*B21D 39/02* (2006.01)

(52) U.S. Cl. ..... 72/220; 72/214; 29/243.57

(58) Field of Classification Search ..... 72/220, 72/312, 214, 466.7, 466.8, 306, 210; 29/243.58, 29/243.57
See application file for complete search history.

(56) References Cited

U.S. PATENT DOCUMENTS

| | | | | |
|---|---|---|---|---|
| 5,224,253 | A | 7/1993 | Sawa | |
| 5,228,190 | A | 7/1993 | Sawa | |
| 5,267,387 | A | 12/1993 | Sawa | |
| 6,425,277 | B1 | 7/2002 | Wiens | |
| 6,477,879 | B1 * | 11/2002 | Sawa | 72/220 |
| 6,640,599 | B1 | 11/2003 | Persson | |
| 6,694,793 | B1 | 2/2004 | Persson | |
| 6,983,633 | B1 * | 1/2006 | Holmgren et al. | 72/220 |
| 2004/0035172 | A1 | 2/2004 | Sawa | |

FOREIGN PATENT DOCUMENTS

| | | | |
|---|---|---|---|
| CA | 2 366 960 | A1 | 10/2000 |
| DE | 100 11 854 | A1 | 9/2001 |
| EP | 0 525 759 | A1 | 2/1993 |
| EP | 0 577 876 | B1 | 9/1996 |
| EP | 1 389 498 | A1 | 2/2004 |
| EP | 1 477 155 | A1 | 8/2004 |
| FR | 2 843 549 | A1 | 2/2004 |
| JP | 61262432 | | 11/1986 |
| JP | 2006022 | | 1/1990 |
| JP | 2070325 | | 3/1990 |
| JP | 2197331 | | 8/1990 |
| JP | 3077726 | | 4/1991 |
| JP | 3110030 | | 5/1991 |
| JP | 3204122 | | 9/1991 |
| JP | 4253524 | | 9/1992 |
| JP | 5038535 | | 2/1993 |
| JP | 5185159 | | 7/1993 |
| JP | 5253626 | | 10/1993 |
| JP | 5305357 | | 11/1993 |

(Continued)

*Primary Examiner*—Dmitry Suhol
(74) *Attorney, Agent, or Firm*—Gifford, Krass, Groh, Sprinkle, Anderson & Citkowski, P.C.

(57) ABSTRACT

A hemming machine having a nest adapted to support a part to be hemmed. A hold down is movable between a retracted position in which the hold down is spaced from the part and an extended position in which the part is sandwiched between the hold down and the nest and a guide surface is formed around the periphery of the hold down. A hemming head having a roller hemmer assembly and mounted to and manipulated by a robotic arm. The roller assembly includes a first roller which engages the guide surface during a roller prehemming operation of the part performed by the robotic arm and a second roller which prehems the part.

14 Claims, 5 Drawing Sheets

FOREIGN PATENT DOCUMENTS

| | | |
|---|---|---|
| JP | 6091330 | 4/1994 |
| JP | 6344037 | 12/1994 |
| JP | 7047429 | 2/1995 |
| JP | 7060370 | 3/1995 |
| JP | 7068324 | 3/1995 |
| JP | 7116743 | 5/1995 |
| JP | 7124653 | 5/1995 |
| JP | 7132327 | 5/1995 |
| JP | 7290158 | 11/1995 |
| JP | 7299526 | 11/1995 |
| JP | 7314054 | 12/1995 |
| JP | 8164433 | 6/1996 |
| JP | 8174100 | 7/1996 |
| JP | 9220626 | 8/1997 |
| JP | 10180373 | 7/1998 |
| JP | 10249455 | 9/1998 |
| JP | 11309527 | 11/1999 |
| JP | 11309528 | 11/1999 |
| JP | 11314121 | 11/1999 |
| JP | 2000061557 | 2/2000 |
| JP | 2000246351 | 9/2000 |
| JP | 2001062530 | 3/2001 |
| JP | 2001071065 | 3/2001 |
| JP | 2001105056 | 4/2001 |
| JP | 2001252730 | 9/2001 |
| JP | 2001314928 | 11/2001 |
| JP | 2002011525 | 1/2002 |
| JP | 2002035865 | 2/2002 |
| JP | 2002102957 | 4/2002 |
| JP | 2003103325 | 4/2002 |
| JP | 2002143952 | 5/2002 |
| JP | 2002160031 | 6/2002 |
| JP | 2002239656 | 8/2002 |
| JP | 2002263756 | 9/2002 |
| JP | 2002301527 | 10/2002 |
| JP | 2003225721 | 8/2003 |
| JP | 2003225722 | 8/2003 |
| WO | WO 00/54902 A1 | 9/2000 |
| WO | WO 03/004189 A1 | 1/2003 |
| WO | WO 03/024641 A1 | 3/2003 |
| WO | WO 03/037541 A1 | 5/2003 |
| WO | WO 2004002648 A2 | 1/2004 |

* cited by examiner

ROLLER HEMMING MACHINE

RELATED APPLICATION

This application claims priority of U.S. Provisional Patent Application Ser. No. 60/617,542 filed Oct. 8, 2004, which is incorporated herein by reference.

BACKGROUND OF THE INVENTION

I. Field of the Invention

The present invention relates generally to hemming machines for hemming two sheet metal parts together.

II. Description of Related Art

There are many previously known hemming machines for hemming two sheet metal parts together. Such hemming means are used, inter alia, in the automotive industry for hemming car body panels together.

In one type of previously known hemming machine, the part to be hemmed, typically an inner panel nested within an outer panel, is supported on a nest. The nest is then reciprocally driven sequentially against a prehemming tool die set and, thereafter, a final hemming tool die set in order to hem the parts together.

In still a further type of previously known hemming machine, a robotic arm was utilized to move a roller against the part to be hemmed in order to form both the prehem and, thereafter, the final hem. However, in view of deflection of the robotic arm, it has been previously necessary to carefully guide the roller head assembly as it is moved by the robotic arm in order to perform the hem having the required quality finish.

In one type of previously known robotic roller hemmer, a guide surface was formed along the outer periphery of the nest on which the part to be hemmed was positioned. A hemming head having at least one roller was then mounted to the end of the robotic arm so that the hemming head together with its roller(s) moved in synchronism with the robotic arm.

In order to perform the prehem, one of the rollers would engage and be guided by the guide surface formed on the nest during the prehemming (and/or final hem) operation. Since the guide surface on the nest can be very accurately manufactured relative to the part to be hemmed, it is possible to achieve accurate prehems with the robotic roller hemmer. Once the accuracy of the prehemming operation is achieved, typically in multiple passes (two to three), the final prehem can be performed, typically in multiple passes.

A disadvantage of these previously known robotic roller hemmers which utilized a guide surface on the nest to position the hemming head during the hemming operation is that it is fairly expensive to manufacture and tune the guide surface on the nest. Furthermore, in case of wearing or quick geometry adjustment required by production, since the roller guiding track is part of the nest, any adjustment requires direct grinding or rewelding/regrinding of the nest itself.

A still further disadvantage of the previously known robotic roller hemming machines is that such machines typically utilized a pressurized air cylinder actuator between the robot and the roller head to create the pressure on the hemming rollers. Such air cylinder actuators, however, either are traditional air cylinders which are room consuming, or simple convolution air bladders which vary in pressurization, and thus the force applied to the hemming rollers, as a function of the extension of the air cylinder. Such uneven pressure applied by the hemming roller on the part in turn may result in an inconsistent or non-uniform hem on the part.

SUMMARY OF THE PRESENT INVENTION

The present invention provides a hemming machine which overcomes all of the above-mentioned disadvantages of the previously known devices.

In brief, the hemming machine of the present invention comprises a nest which is adapted to support the part to be hemmed. Typically, the part to be hemmed includes an outer panel having an upwardly extending flange around its outer periphery and an inner panel nested within the outer panel flange. Such parts include, for example, automotive closure panels such as door panels.

After the part to be hemmed is positioned within the nest, a hold down is movable between a retracted position in which the hold down is spaced from the part, and an extended position in which the part is sandwiched between the hold down and the nest. In its extended position, the hold down traps both panels of the part to be hemmed between the hold down and the nest and prevents movement of the parts during the hemming operation.

A guide surface corresponding to the shape of the desired hem is formed around the outer periphery of the hold down.

A hemming head is mounted to the free end of a conventional robotic arm. This hemming head includes a roller hemming assembly mounted to it so that the roller assembly moves in unison with the hemming head.

In operation, the robotic arm is programmed such that at least one of the rollers on the roller hemmer assembly engages the guide surface on the hold down during the prehemming operation. Following the prehemming operation, the robotic arm together with the hemming head and its attached roller hemmer assembly is used to perform the final hem on the part.

Since the guide surface is formed on the hold down, rather than the nest, the guide surface can be relatively inexpensively machined and tuned on the hold down.

Preferably, the roller hemming head comprises a base which is attached to the robotic arm, a piston shaft slidably mounted to the base, and the hemming roller head is in turn mounted to the piston shaft. A rolling sleeve type diaphragm is disposed around both the piston shaft and the base to form a closed chamber around the linear guiding slide. This chamber is pressurized by an external pressure source, such as a pressurized air source, in order to maintain pressure within the bladder and, consequently, an outward force on the roller hemmer heads relative to the robotic arm. Since the rolling sleeve encompasses the guiding slide, a uniform pressure is exerted on the roller hemming head despite fluctuations in the extension of the slide which ensures a uniform bending of the hem flange, and then a uniform hem.

A sensor detects the position of the piston shaft to detect whenever the piston shaft is fully extended or fully retracted, both of which would be indicative of a machine failure or error of some sort.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
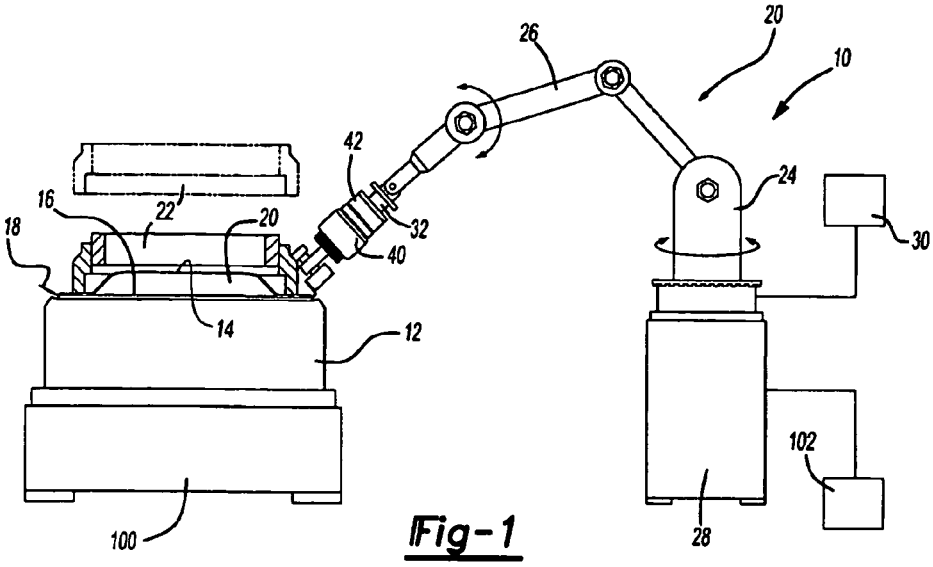
FIG. 1 is a side diagrammatic view illustrating a preferred embodiment of the present invention.

With reference first to FIG. 1, a preferred embodiment of the hemming machine 10 of the present invention is shown and comprises a nest 12 which is adapted to support a part 14 to be hemmed. As better shown in FIG. 4, the part 14 to be hemmed includes an outer sheet metal panel 16 having a flange 18 about its outer periphery, and an inner panel 20 nested within the outer flange 18 of the outer panel 16.

Figure 4:
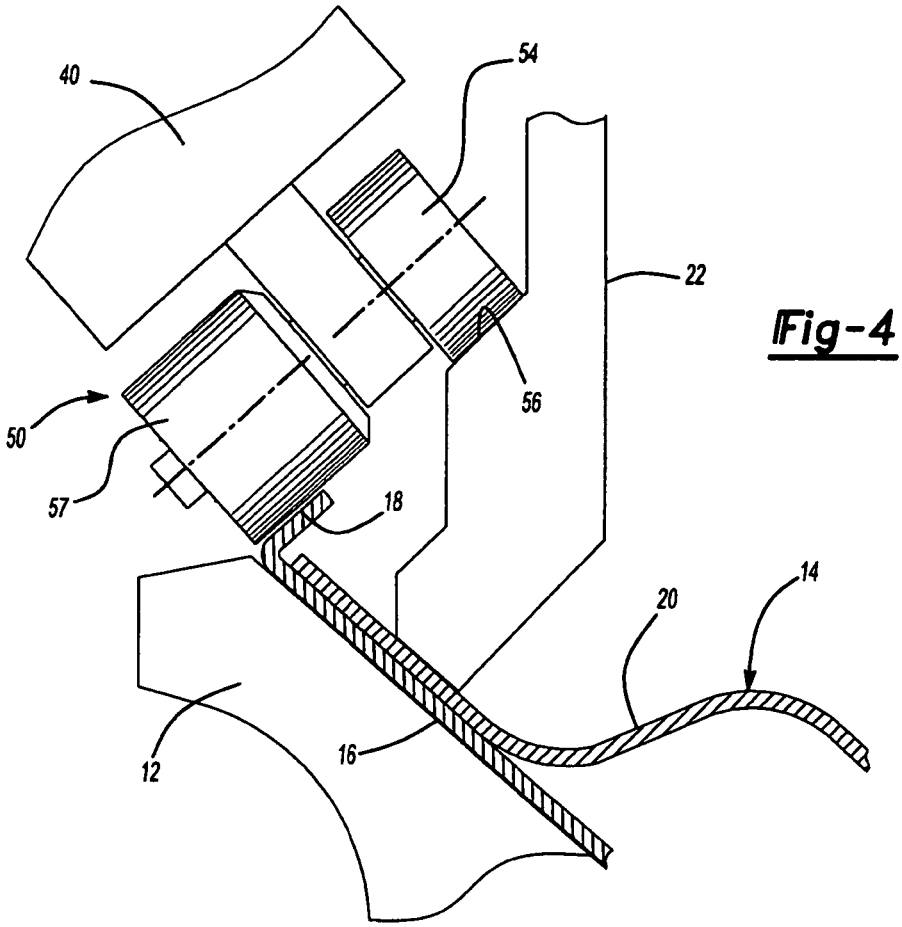
FIG. 4 is an exploded fragmentary view illustrating a prehemming operation.

Still referring to FIG. 1, a hold down 22 is movable relative to the nest 12 between a retracted position, illustrated in phantom line in FIG. 1, and an extended position, illustrated in solid line in FIG. 1. In its retracted position, the hold down 22 is spaced from both the nest 12 and the part 14 to be hemmed thus allowing both a finished part 14 to be removed from the nest 12, and a new unhemmed part 14 to be accurately positioned on the nest 12 by retractable "sweepers". Conversely, as best shown in FIG. 4, in its extended position, the hold down 22 abuts against the inner panel 20 accurately locating it on the part 14 through locating pins, to bring it into reference with the outer panel. Then it sandwiches the part to be hemmed between the hold down 22 and the nest 12. The hold down 22, when in its extended position, thus prevents movement of the part 14 relative to the nest 12 during the hemming operation.

As best shown in FIG. 4, a guide surface 56 is formed around the outer periphery of the hold down 22. This guide surface conforms to the shape of the desired prehem passes for the part 14. If two prehem operations are required, the hold down will present two separate tracks located on two separate steps attached to the hold down perimeter.

With reference again to FIG. 1, the hemming machine 10 further comprises a programmable robot 24 having a robotic arm 26 which is movable, under program control, relative to a base 28 of the robot 24. The robot 24, furthermore, may be of any conventional construction and includes a control system 30 which controls the position of a wrist 32 of the robotic arm 26 relative to the base 24.

Figure 2:
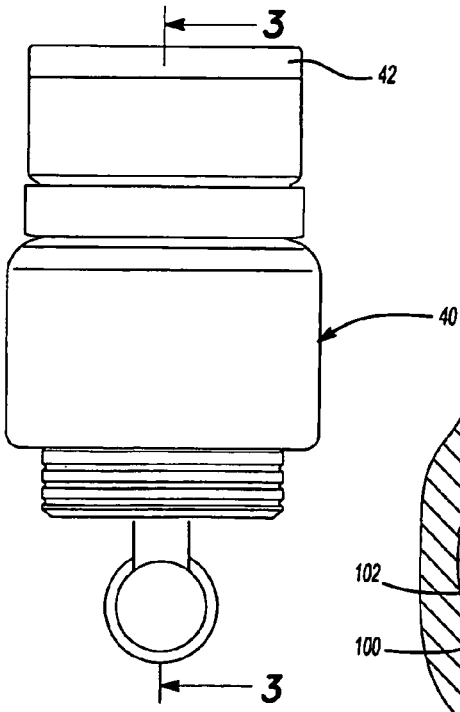
FIG. 2 is a side view illustrating the hemming head of the preferred embodiment of the present invention.
Figure 3:
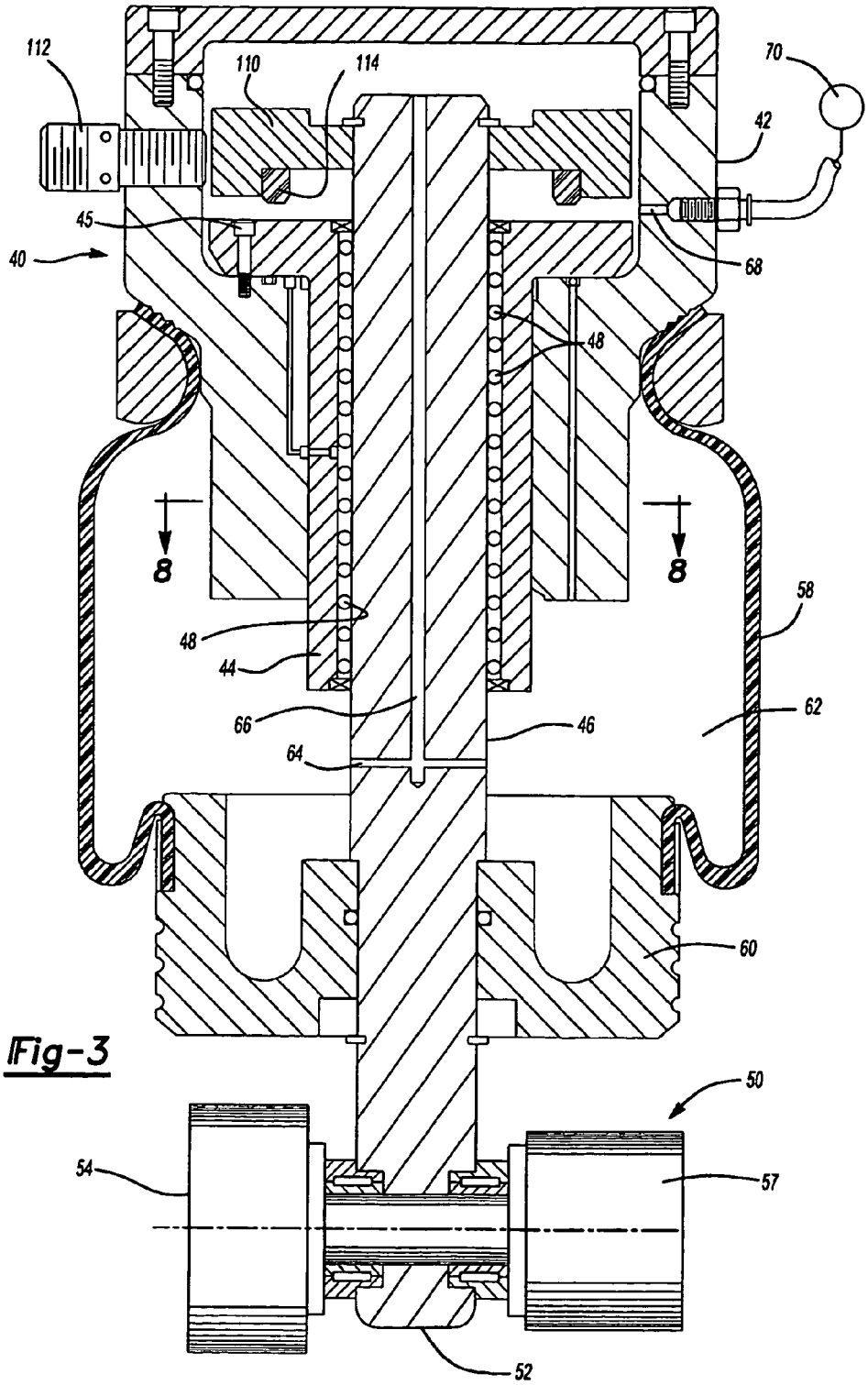
FIG. 3 is a sectional view taken substantially along line 3—3 in FIG. 2 and enlarged for clarity.

With reference now to FIGS. 1–3, a hemming head 40 includes a base 42 which is mounted to the wrist 32 of the robotic arm 26. As best shown in FIG. 3, the base 42 includes a linear guide 44 secured to the base 42 by fasteners 45, while an elongated piston shaft 46 is slidably mounted through the guide 44.

Figure 8:
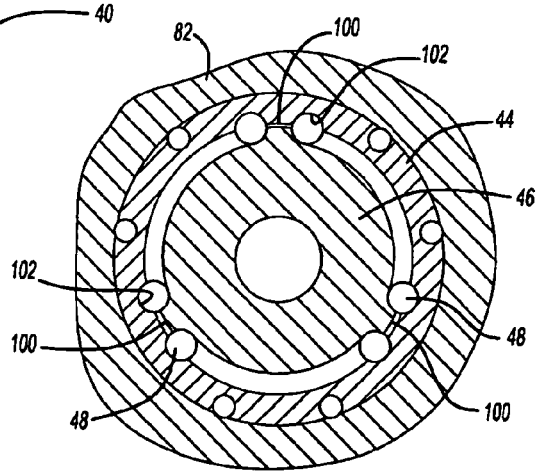
FIG. 8 is a sectional view taken along line 8—8 in FIG. 3.

With reference now particularly to FIGS. 3 and 8, the piston shaft 46 includes at least one, and preferably three equidistantly spaced, longitudinally extending wings or ridges 100 along the outer surface of the piston shaft 46. A plurality of roller bearings 48 are then disposed between receiving channels 102 formed in the linear guide 44 and the piston shaft 46 on both sides of each wing 100. The roller bearings 48 enable the piston shaft 46 to slide in a pure linear longitudinal direction relative to the base 42 and guide 44 while the coaction between the roller bearings 48 and wings 100 prevents rotation of the piston shaft 46 about its longitudinal axis.

A roller hemmer assembly 50 is mounted to one end 52 of the piston shaft 46. The roller assembly 50 includes at least one, and preferably two rollers 54 and 57. The rollers 54 and 57 are illustrated in FIG. 3 as being coaxially rotatably mounted to the piston 46.

A flexible rolling sleeve type air bladder 58 sealingly connects the base 42 to a piston end cap 60 attached to the piston shaft 46. The bladder 58 thus defines an internal closed chamber 62 between the base 42 and the piston 46, which contains and encloses the linear guide 44. This chamber 62 is fluidly connected by ports 64, 66 and 68 to a source 70 of pressurized fluid, such as pressurized air. Consequently, in operation, the pressurized fluid from the source 70 pressurizes the bladder chamber 62 and maintains an outward force on the piston end cap 60 to the piston shaft 46, together with its attached roller assembly 50, relative to the base 42 of the hemmer head 40 and thus relative to the free end 32 of the robotic arm 26.

With reference now to FIG. 3, a sensor disc 110 is attached to the piston shaft 46 at its end opposite from the hemming rollers 54 and 57. A position sensor 112 is mounted to the base 42 at a position radially aligned with the disc 110 and generates an output signal representative of the position of the disc 110 and thus representative of the degree of extension or retraction of the piston shaft 46. Consequently, whenever the piston shaft 46 reaches its fully extended or fully retracted position, indicative of an error or equipment malfunction, the sensor 112 generates an output signal to the operator so that the appropriate corrective action may be taken. A resilient shock absorber 114 is also preferably attached to the disc 110 to minimize the possibility of damage to the hemming head in the event the piston shaft 46 moves to its fully extended position.

With reference again to FIG. 4, in operation, the part to be hemmed 14 is mounted on the nest 12 and the hold down 22 is moved to its extended position. In doing so, the hold down 22 clamps the part 14 against the nest 12 and prevents movement of the part 20 during the hemming operation.

With reference now to FIGS. 1 and 4, during the prehemming operations, the robotic arm 26 is manipulated under program control by the control system 30 so that one roller 54 of the roller hemming head 40 is positioned against one of the tracks of the guide surface 56 formed around the hold down 22.

As the guide roller 54 is positioned against the guide surface 56 on the hold down 22, the robotic arm 26 manipulates the hemming head 40, and thus the roller assembly 50, such that the guide roller 54 abuts against and follows the hold down guide surface 56. Simultaneously, the hemming roller 57 engages the flange 18 on the part 14 to be hemmed and performs the prehem of the flange 18 in the desired fashion.

It is understood that the same guiding concept can also be applied to guide the hemming roller during the final hem operation, either laterally when a rope profile or any particular profile like a burrs-off kick-off flange has to be done, or to restrict the compression of the flange if an open flange is locally required.

Figure 9:
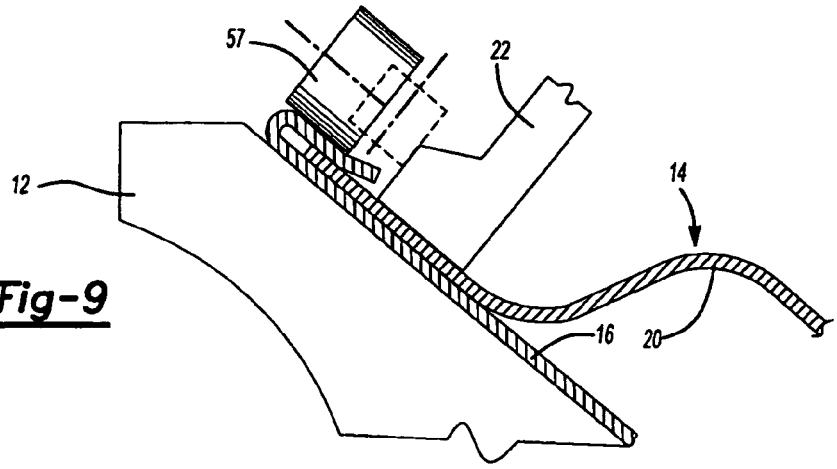
FIGS. 9–11 are fragmentary views illustrating different final hemming operations.
Figure 10:
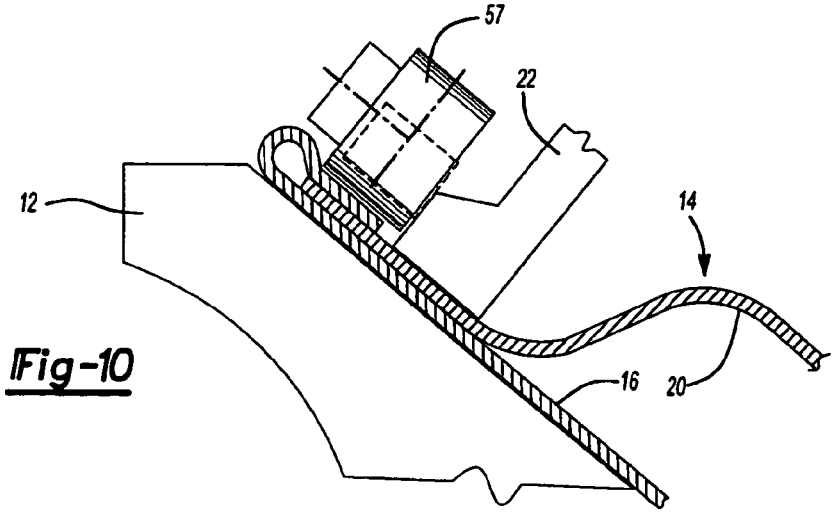
Figure 11:
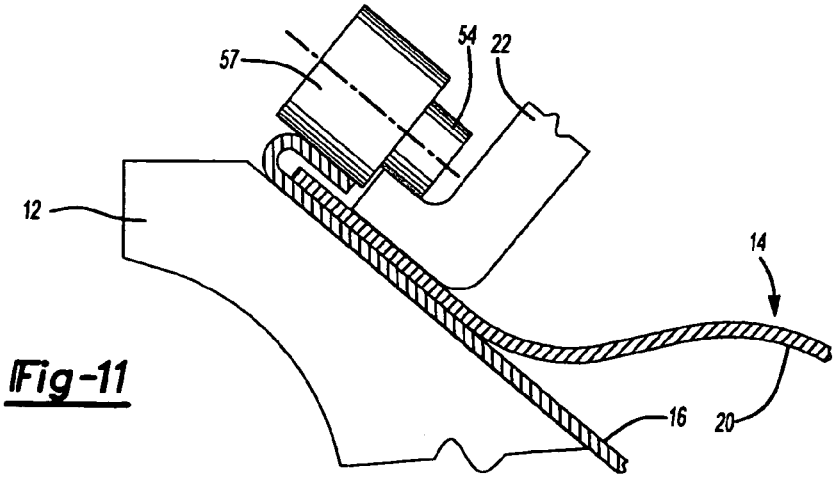

For example, FIGS. 9–11 all depict the roller 57 used to perform a final hem. The hemming head optionally uses the hold down 22 as a guide for the roller 54 during the final hem.

During the prehemming operation, the robot 24 manipulates the roller assembly 50 around the entire periphery of the part 14 while maintaining the guide roller 54 in abutment with the guide surface 56. Optionally, the nest 12 is swivelly mounted relative to a ground support surface to minimize the necessary extension of the robotic arm 26. In this case the robot 24 first performs a prehem pass around about one half of the part 14, the nest 12 is swiveled about 180 degrees, and the robot 24 then completes the remainder of the prehem pass.

Figure 5:
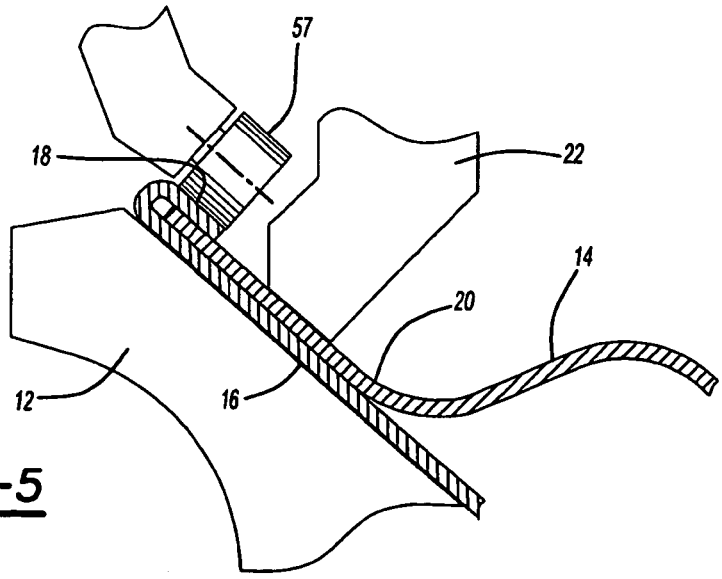
FIG. 5 is a view similar to FIG. 4, but illustrating a final hemming operation.

With reference now to FIG. 5, following the hemming operation, the robotic arm 26, under program control, manipulates the roller assembly such that one of the rollers of the roller assembly 50, e.g. the roller 57, engages the previously prehemmed flange 18 and compresses the flange 18 against the inner panel 20 to complete the hem between the two panels 16 and 20 of the part 14.

Figure 6:
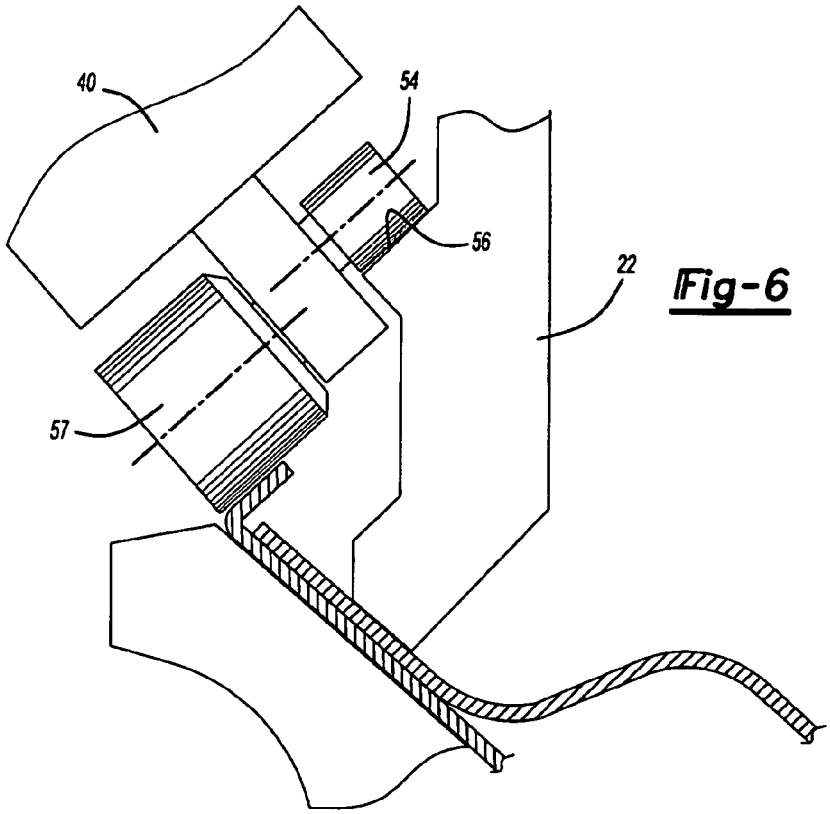
FIG. 6 is a view similar to FIG. 4, but illustrating a modification thereof.

Although the rollers 54 and 57 are illustrated in FIG. 4 as being coaxially mounted to the hemming head 40, it is not necessary that the rollers 54 and 57 be coaxial with each other. For example, as illustrated in FIG. 6, an alternate embodiment is illustrated in which the two rollers 54 and 57 are both mounted to the hemming head 40 along parallel, but not coaxial, axes.

Figure 7:
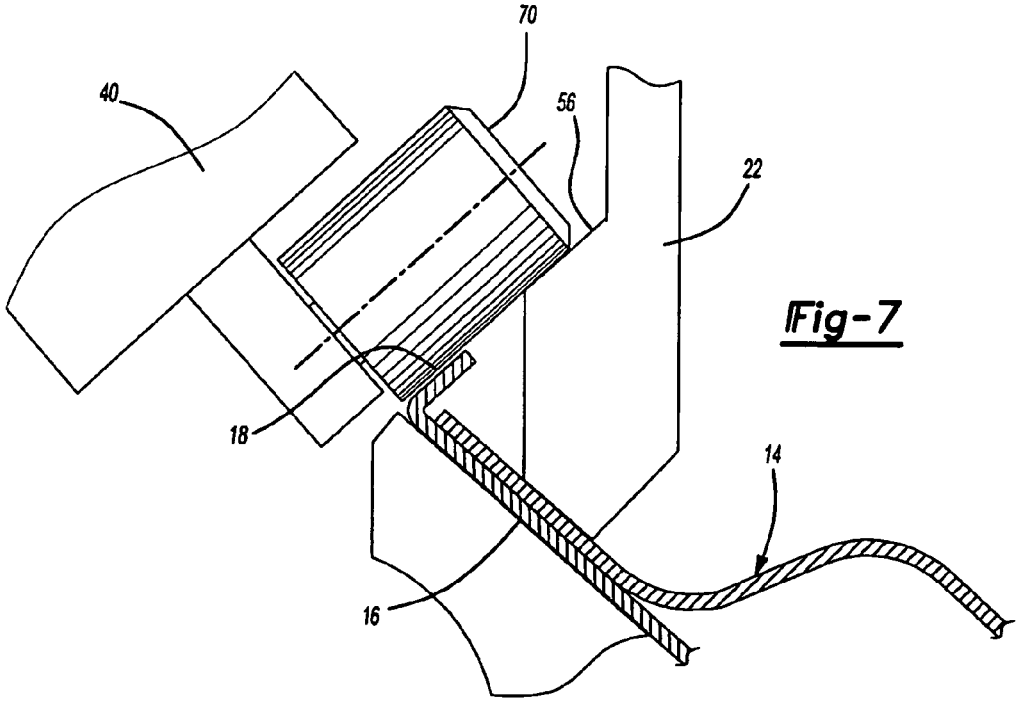
FIG. 7 is a view similar to FIGS. 4 and 6, but illustrating a further modification thereof.

Similarly, it is not necessary that the roller assembly 50 include two or more rollers. For example, as shown in FIG. 7, a single roller 70 may be rotatably mounted to the hemming head 40. In this case, the roller 70 would be dimensioned so that one end of the roller 70 contacts and is guided by the guide surface 56 on the hold down 22 while the opposite end of the roller 70 engages the flange 18 on the outer panel 16 of the part 14 and performs the hemming operation.

A primary advantage of the present invention is that, since the sleeve encompasses and contains the slide mechanism for the hemming head, the hemming head is very compact. Furthermore, the use of a rolling sleeve type air bladder ensures that a constant pressure is maintained for the hemming rollers regardless of the extension or retraction of the piston shaft assuming, of course, that the piston shaft is neither fully extended nor fully retracted.

Furthermore, although the hemming head has been described for use with a hold down having a guide surface, it will be understood that the hemming head may be used with hemming machines having a guide surface formed on components other than the hold down, such as the nest.

From the foregoing, it can be seen that the present invention provides a simple and yet highly effective roller hemming machine which utilizes a guide surface on the part hold down to guide the hemming rollers during the prehemming operation. Having described my invention, however, many modifications thereto will become apparent to those skilled in the art to which it pertains without deviation from the spirit of the invention as defined by the scope of the appended claims.

We claim:

1. A hemming machine comprising:

a nest adapted to accurately locate and support a part to be hemmed, a hold down movable between a retracted position in which said hold down is spaced from said part and an extended position in which the part is sandwiched between said hold down and said nest, wherein said hold down includes at least one guide surface formed about the periphery of said hold down, a robotic arm, a roller hemming head mounted to said robotic arm, a roller hemmer assembly mounted to said hemming head, wherein said roller hemmer assembly includes a first roller which engages said guide surface during a roller hemming operation of the part.

2. The invention as defined in claim 1 wherein said roller hemmer assembly comprises a second roller which engages the part and forms a hem as said first roller engages and travels along said guide surface.

3. The invention as defined in claim 2 wherein said first and second rollers are coaxially rotatably mounted to said hemming head.

4. The invention as defined in claim 2 wherein said robotic arm manipulates one of said rollers following prehemming operation so that said one roller engages the part to perform a final hem on said part.

5. The invention as defined in claim 1 wherein said hemming head comprises a base attached to said robotic arm, a piston shaft slidably mounted to said base and said hemming head being mounted to said piston.

6. The invention as defined in claim 5, and comprising a rolling sleeve type inflatable bladder disposed between said piston and said base and forming a chamber around a portion of said piston, and a pressurized fluid source fluidly connected to said chamber.

7. A roller hemming head for use with a robot comprising:

a base adapted for attachment to the robot, a guide assembly mounted to said base, an elongated piston shaft axially slidably mounted to said assembly, said piston shaft being movable between an extended and a retracted position, at least one hemming roller attached to a free end of said piston shaft, a flexible sleeve connected between said base and said shaft and forming a pressurizable chamber encompassing said guide assembly, a source of fluid pressure fluidly connected to said pressurizable chamber.

8. The invention as defined in claim 7 and comprising a position transducer attached to said base, said position transducer providing an output signal representative of the position of the piston shaft relative to said guide assembly.

9. The invention as defined in claim 7 and comprising a disc attached to an end of said shaft contained within said chamber, said disc limiting the extent of retraction arid extension of said piston shaft relative to said guide assembly.

10. The invention as defined in claim 9 and comprising a shock absorber attached to said disc.

11. The invention as defined in claim 7 and comprising means to prevent rotation of said piston shaft relative to said guide assembly.

12. The invention as defined in claim 11 wherein said rotation preventing means comprises at least one longitudinally extending and outwardly protruding wing on said piston shaft, a longitudinal channel formed in said guide assembly on each side of said wing, and roller bearings disposed in said longitudinally extending channels so that said roller bearings abut against both said wing and said guide assembly to thereby lock said piston shaft against rotation relative to said guide assembly.

13. The invention as defined in claim 12 wherein said at least one wing comprises at least three wings.

14. The invention as defined in claim 13 wherein said wings are equidistantly spaced from each other.

* * * * *